US005829639A

United States Patent [19]

Horner et al.

[11] Patent Number: 5,829,639

[45] Date of Patent: Nov. 3, 1998

[54] FLOWABLE MATERIAL DISPENSER WITH CHAMBERS

[75] Inventors: Terry A. Horner, 143 S. Main, Allentown, N.J. 08256; Peter E. Gruendeman, Allentown, N.J.

[73] Assignee: Terry A. Horner, Allentown, N.J.

[21] Appl. No.: 742,047

[22] Filed: Oct. 31, 1996

[51] Int. Cl.[6] ..... B67D 5/52

[52] U.S. Cl. ..... 222/137; 222/145.6; 222/386; 222/459

[58] Field of Search ..... 222/94, 103, 135, 222/136, 137, 145.5, 145.6, 386, 459

[56] References Cited

U.S. PATENT DOCUMENTS

| | | | |
|---|---|---|---|
| 3,827,602 | 8/1974 | Nicholls | 222/137 |
| 4,331,264 | 5/1982 | Staar | 222/94 |
| 4,341,302 | 7/1982 | Baker et al. | 206/219 |
| 4,565,303 | 1/1986 | Gilbertson | 222/103 |
| 5,033,650 | 7/1991 | Colin et al. | 222/456 |
| 5,114,044 | 5/1992 | Spanek, Jr. | 222/94 |
| 5,269,441 | 12/1993 | O'Meara | 222/94 |
| 5,318,203 | 6/1994 | Iaia et al. | 222/94 |

*Primary Examiner*—Joseph Kaufman
*Attorney, Agent, or Firm*—Davis and Bujold

[57] ABSTRACT

A dispenser for storing and dispensing two flowable materials, preferably comprising a single piece container having a driving member, a storage member having an discharge nozzle defining two separate passages and two cylinders each communicating with a separate one of said passages and a hinged member joining the driving member and the storage member by way of living hinges, the driving member defines two pistons located and sized to sealingly engage the cylinder when the driving member and the storage member are folded about the living hinges into engagement with one another; the cylinders being isolated from one another. When squeezing force is applied the driving member and the storage member act against one another to expel the materials through the passages of the discharge nozzle for blending of the ingredients upon exit from therefrom.

9 Claims, 6 Drawing Sheets

FLOWABLE MATERIAL DISPENSER WITH CHAMBERS

FIELD OF THE INVENTION

The present invention relates generally to a hinged dispensing package for the accommodation and dispensation of materials and more particularly to inexpensive one piece containers with multiple chambers for the isolated storage and simultaneous dispensation of small amounts of flowable materials, for example, epoxies or multiple component toothpastes.

BACKGROUND OF THE INVENTION

There are a number of two component reactive chemicals that need to be dispensed and mixed at the point of use, for example, epoxies for fastening or peroxide/ baking soda for a popular toothpaste. In order to supply the chemicals to the point of use, several types of two component hand held dispensers have been developed. For example, the Mentadent toothpaste or 3M's two components Express adhesive syringe.

An example of two component dispensing systems is found in the toothpaste market wherein the successful use of baking soda with peroxide to obtain a superior product for use in good oral hygiene requires separate storage and simultaneous dispensation as an undesirable chemical reaction takes place when baking soda and peroxide are stored together. It is, therefore, essential, or at least highly desirable, to keep these two active ingredients isolated until use.

The use of dispensers with two isolated storage chambers are know in the art. Cheesebrough-Ponds has a container that uses two isolated storage chambers, one for the baking soda ingredient and one for the peroxide ingredient. The two active ingredients are keep separate until use, at that time a pump mechanism delivers the two ingredients which are blended together just prior to use.

While the Cheesebrough-Ponds dispenser maintains isolation of the ingredients until use, it consists of several separate molded parts and is expensive to manufacture. The cost of the dispenser is important because it is disposable and the ingredients stored in the dispenser are often used several times a day resulting in a short life for the dispenser.

All other multi-component dispensers utilize systems operating on similar principle. The dispenser assembly consists of two parallel cylinders which store the contents, and a drive assembly that pushes the pistons down the cartridge cylinders. In order to ensure volumetric dispensing, the drive assembly and the syringe assembly must be rigidly aligned. If the assembly is allowed to pivot or sway with regards to the axial alignment of the assembly, the volumetric ratio of the contents will change during the dispensing stroke and this is very undesirable.

Such dispensers are complex and expensive.

Considering these and other problems, it is an object of the present invention to provide a single piece inexpensive disposable package for storing and dispensing flowable materials.

Another object is to provide a single piece package with at least two isolated chambers connected to a discharge nozzle so that the contents of the chambers are isolated until discharge.

Another object is to provide a package that is reliable, comfortable to hold and easy to use.

Another object is to provide a package where the discharge nozzle comprises a static mixer for intermixing the contents of the cylinders prior to discharge.

Another object is to provide a dispenser with a maintained dispensing volumetric ratio where the pistons travel is non-linear.

SUMMARY OF THE INVENTION

The Applicants have developed a hand held dispenser that pivots together and assures correct volumetric ratio of the expelled contents. The assembly consist of two cylinders which store the contents and a drive assembly that pushes pistons into the cylinders about one or more hinges. The two halves of the dispenser are rotated together about the hinge (s) and squeezed flat to expel the contents of the dispenser. Preferably two hinges are provided to compensate for the rotation of the two halves and assure that the pistons remain in the center of the cylinder bore.

Generally the present invention provides an inexpensive single piece molded dispenser with multiple chambers for the isolated storage and dispensation of desired amounts of flowable materials wherein the single piece molded dispenser comprises a driving member, a storage member with multiple storage chambers where the storage chambers can have any shape, however, round chambers offer the lowest cost to produce and a hinged member with two living hinges (repeatedly foldable plastic members integral with the elements they interconnect).

After molding, the single piece dispenser is folded at the two living hinges and snapped together so that the driving member and the storage member act upon each other when pressure is applied. Once snapped together different ingredients can be back filled through an discharge nozzle into the separate storage chambers. Alternatively the chamber may be filled prior to folding.

After the storage chambers are filled a user can apply pressure to force the driving member and the storage member to act towards each other thus expelling the contents of the separate storage chambers separately through a discharge nozzle at the outlet of which the contents are blended. The discharge nozzle could be fitted with a cap when not in use. The cap can be molded on a lanyard attached to the dispenser, this would prevent loss of the cap and reduce the cost of manufacture.

According to one aspect of the invention provides a dispenser for storing and dispensing a plurality of flowable materials comprising: a) a driving member; b) a storage member having a discharge nozzle defining a plurality of separate passages and a like plurality of cylinders, for housing the materials, each communicating a separate one of the passages; and c) hinge means joining the driving member and the storage member, wherein d) the driving member further comprises a piston located and sized to sealingly engage each cylinder when the driving member and the storage member are engaged with one another, whereby the cylinders are isolated from one another and a squeezing pressure is applied so that the driving member and the storage member act against one another to simultaneously expel materials from the cylinders, when therein, through the passage of the discharge nozzle.

According to another aspect, the invention provides a dispenser for storing and dispensing separated flowable materials comprising a one piece container defining means for containing the materials separately and means for discharging the materials simultaneously through separate exits.

According to another aspect, the invention provides a dispenser for storing and dispensing two flowable materials comprising: a single piece container having (a) a driving member, (b) a storage member having an discharge nozzle defining two separate passages and two cylinders, for housing the materials, each communicating with a separate one of the passages and (c) a hinged member joining the driving member and the storage member by way of living hinges, the driving member defines two pistons located and sized to sealingly engage the cylinders when the driving member and the storage member are folded about the living hinges into engagement with one another; whereby the cylinders are isolated from one another and a squeezing pressure is applied so that the driving member and the storage member act against one another to expel the materials, when in the cylinders, through the passages of the discharge nozzle to be blended at the exit thereof.

According to another aspect, the dispenser could consist of multiple parts. The parts that comprise the dispenser are (a) a driving member having two pistons, (b) a storage member having a discharge nozzle defining two separate passages and two cylinders each communicating with a separate one of the passages and (c) a hinged member joining the driving member and the storage member. The pistons, discharge nozzle and the cylinders can also be separately constructed and secured in the driving or storage members. The hinged member could comprise a ball and socket or rod and hook type capable of joining two separate parts and securing the hinged parts during operation. Additionally, the hinged member can be located on either side of the dispenser as opposed to its end.

In another aspect, the discharge nozzle can comprise a static mixer so that the ingredients in the cylinders are mixed during passage through the discharge nozzle prior to discharge. In one version, the static mixer may be separate from the dispenser to be attached prior to use by, for example, a bayonet fitting.

In another aspect, the hinged member could allow the pistons to travel non-linearly in the cylinders and still maintain volumetric dispensing ratios. The storage member and the driving member are connected by the hinge and during operation the two members act on each other until the content of the cylinders are completely dispensed and the two members are flat. The pistons maintain a seal with the cylinder wall throughout the dispensing cycle. Because the pistons must rotate about the hinges, when the pistons enter the cylinders there is a certain amount of tipping within the cylinders. Preferably the maximum amount of piston tipping measured from the axial center of the cylinders is plus or minus 7.5 degrees or even plus or minus 10 degrees. The hinges compensate for the rotation of the members during operation and assure that the pistons remain in the acceptable range from the center of the cylinder bores resulting in maintained volumetric dispensing ratios.

In another aspect, different volumetric ratios are achieved by adjusting the cylinder diameters. Because the dispenser pivots at the hinge, different cylinder diameters are used. With a 1:1 ratio, the cylinder closest to the hinge will be larger in diameter with a comparatively short stroke and the cylinder farthest from the hinge will be smaller in diameter with a longer stroke. With different ratio components, these relations can be adjusted. In addition, the pistons and storage chambers are not limited to a cylindrical shape other shapes can be used.

In other aspects, the hinged dispenser could be hand held or placed in a dispensing gun, ideally the dispensing pressure would be around 40–60 psi but could be higher or lower dependant on the application. Additionally, the dispenser could be used for one time application making it disposable. The material used could be a polypropylene or other flexible plastic.

BRIEF DESCRIPTION OF THE DRAWINGS

The invention will now be described, by way of example, with reference to the accompanying drawings, in which.

DETAILED DESCRIPTION OF THE INVENTION

Figure 1:
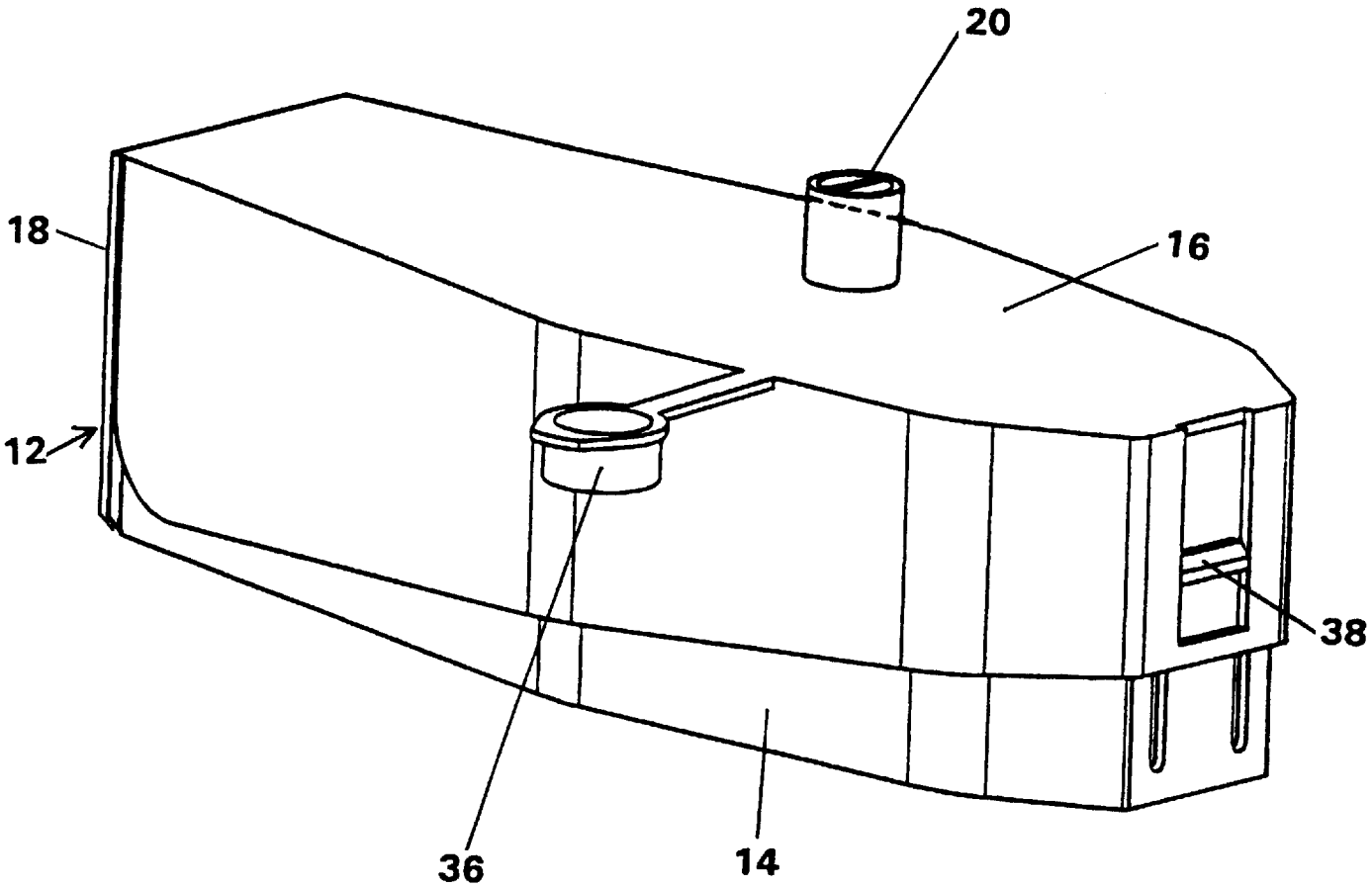
FIG. 1 is a perspective view of the dispenser during a mid-range phase of activation.
Figure 2:
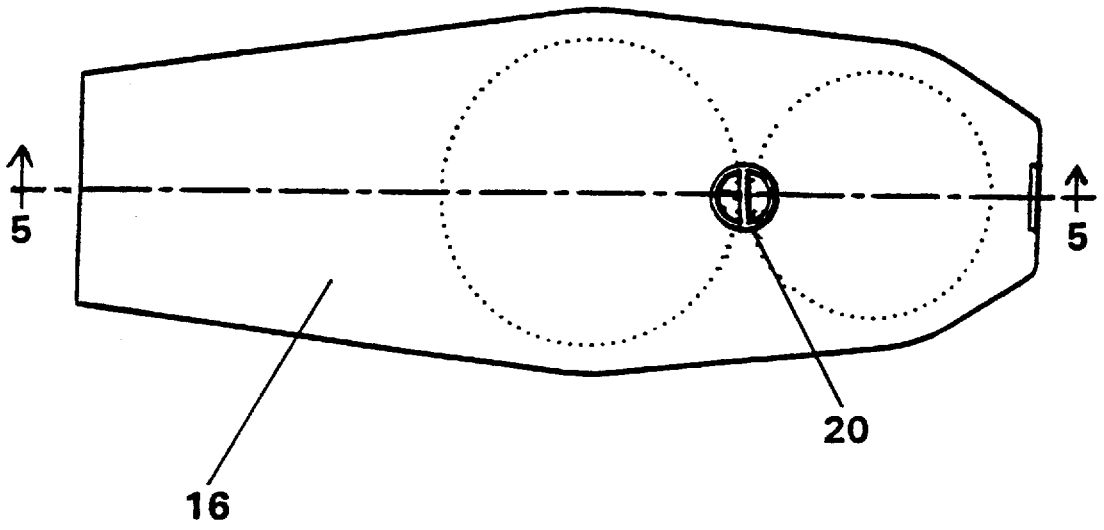
FIG. 2 is a plan view of the dispenser.
Figure 3:
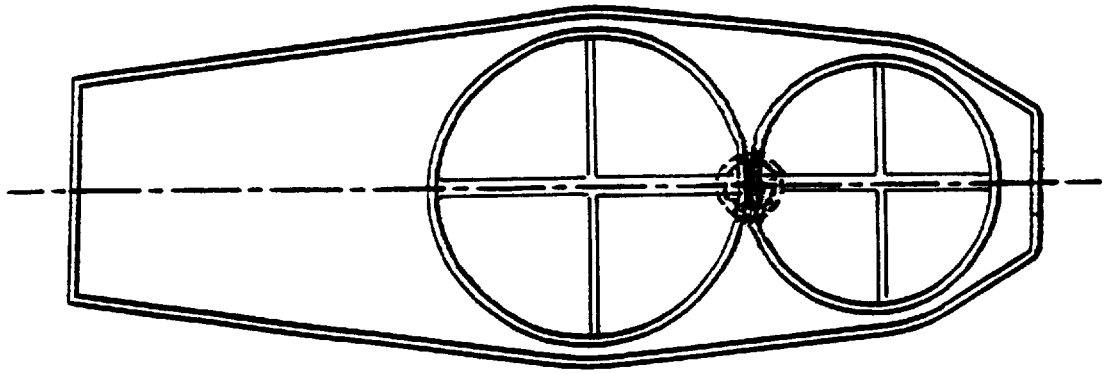
FIG. 3 is an under view of the dispenser.
Figure 4:
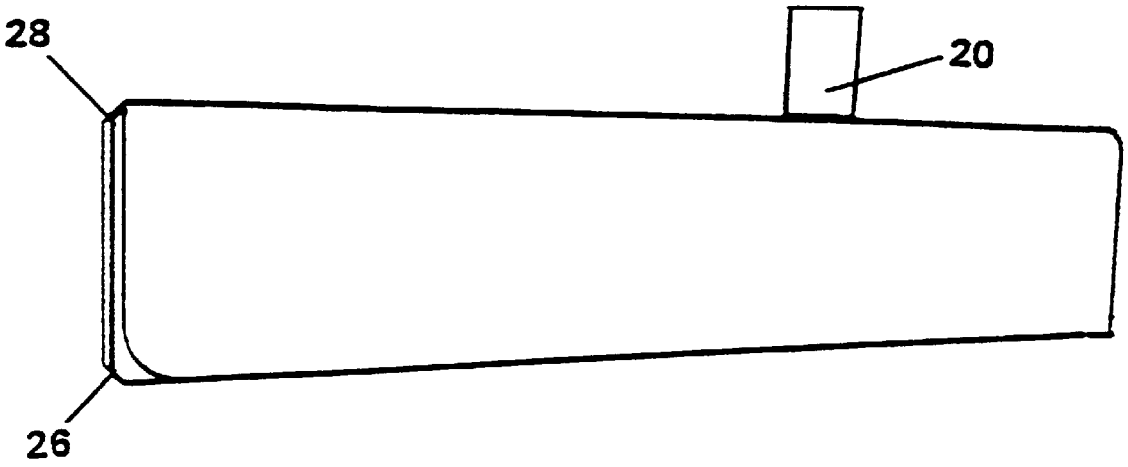
FIG. 4 is a side elevation of the dispenser in its fully activated position.
Figure 5:
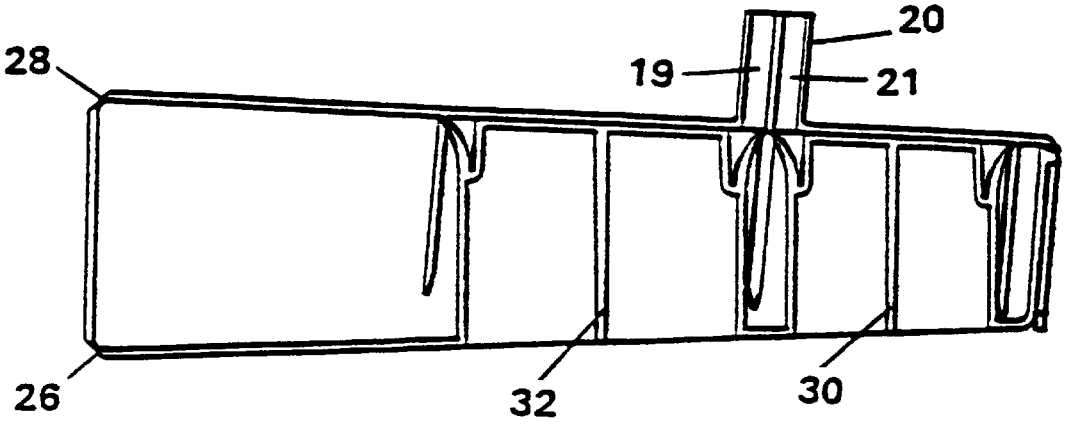
FIG. 5 is a cross-sectional view along section line 5—5 of FIG. 2 depicted in the fully activated position.
Figure 6:
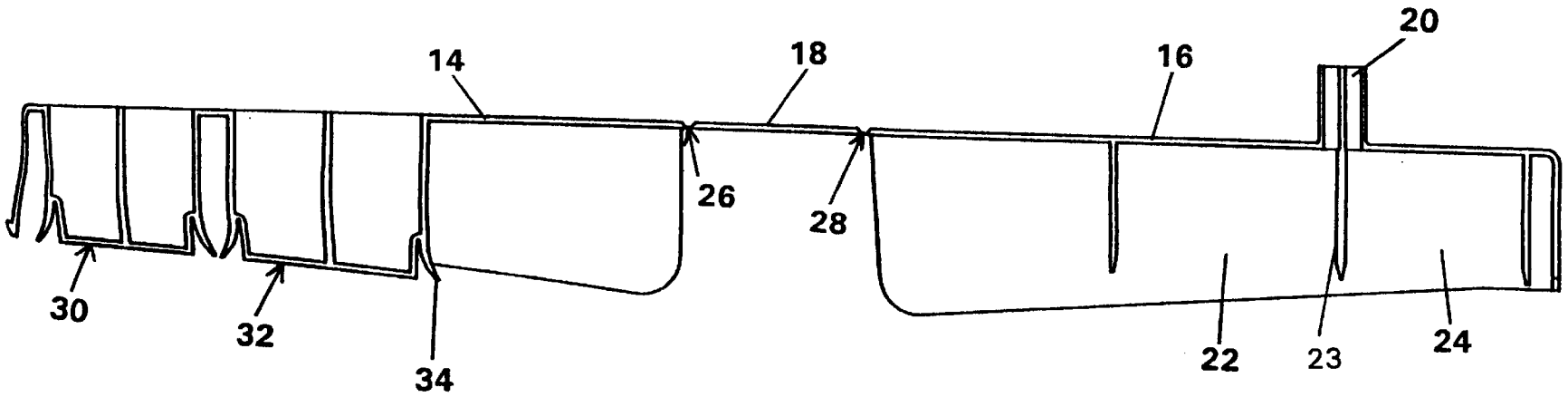
FIG. 6 is the cross-sectional view of FIG. 5 with the dispenser depicted in the fully open position.

An embodiment of the invention as depicted in the drawings, consists of a single piece plastic molding 12 having a driving member 14, a storage member 16 and a hinged member 18. The storage member 16 is shaped to overlap the driving member 14. Once the two are overlapped a latch mechanism 38 is engaged to hold the two members together. A discharge nozzle 20 is provided to dispense product from the dispenser.

The use of a hinged member 18 facilitates the overlapping of the members. Hinged member 18 is situated between the driving member 14 and the storage member 16. A driving member living hinge 26 connects the driving member 14 and the hinged member 18 and a storage member living hinge 28 connects the storage member 16 and the hinged member 18.

Figure 7:
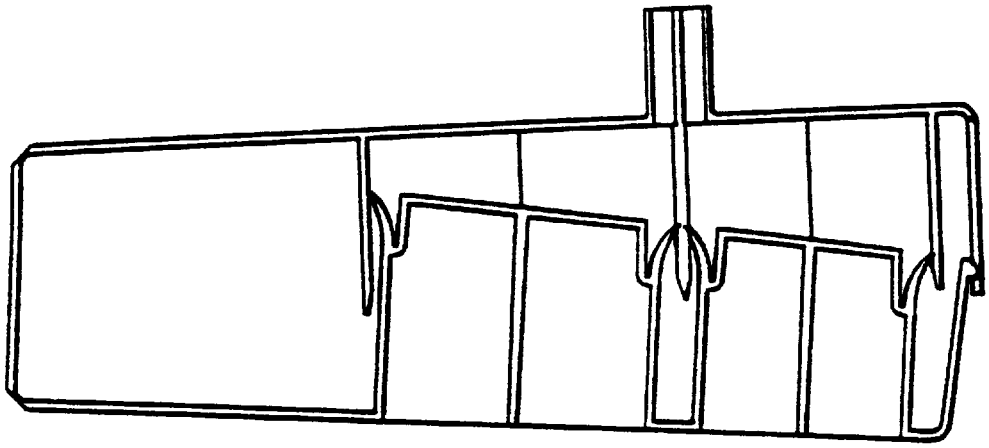
FIGS. 7 and 8 are the cross-sectional view of FIG. 5 with the dispenser depicted in intermediate phases of activation.
Figure 8:
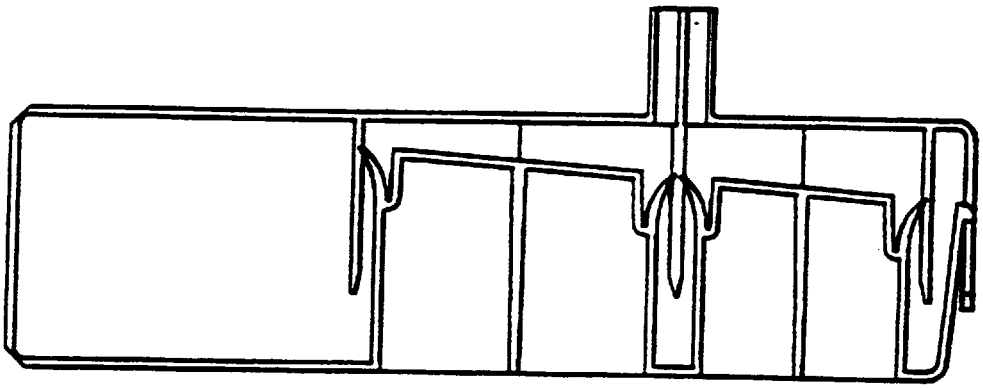

One piece molding allows for the economical one step construction of the driving member 14, storage member 16 and the hinged member 18. The integral living hinges 26 and 28 give the user the ability to manipulate the dispenser 12 into various stages of activation as shown in FIGS. 7 and 8.

Once the driving member 14 and storage member 16 are overlapped and latched, a first storage chamber is formed in the space between a first cylindrical protrusion (piston) 32 of the driving member 14 and a cylinder 22 of the storage member 16 and a second storage chamber is formed in the space between a second cylindrical protrusion (piston) 30 of the driving member 14 and a cylinder 24 of the storage member 16. The split discharge nozzle 20 communicates with the cylinders 22, 24 at a common wall portion 23 of the cylinders 22, 24. Annular piston seals 34 of pistons 30, 32 scalingly engage cylinders 22, 24 to prevent escape of product in the storage containers except through the discharge nozzle 20.

The discharge nozzle 20 has separate first and second passages 19 and 21 and is used as an inlet to back fill two different ingredients separately into the cylinders 22, 24. In the back filling operation it is critical that the two different ingredients are keep isolated from one another. To this end a longitudinal divider separating passages 19 and 21 is integral with wall portion 23.

Once the dispenser 12 is overlapped, latched and back filled, it is ready to be squeezed to simultaneously dispense the two ingredients. A user grasps the dispenser 12 and squeezes the storage member 16 and the driving member 14 toward each other resulting in the ejection of the separated ingredients in the cylinders 22, 24 through the split discharge nozzle 20. The dispenser 12 may be repeatedly used until the contents of the cylinders 22 and 24 are empty. When not in use a cap 36 integrally formed as a part of the dispenser 12 is fitted over the discharge nozzle 20 so that the contents of the chambers 22 and 24 do not leak through the discharge nozzle 20.

Figure 9:
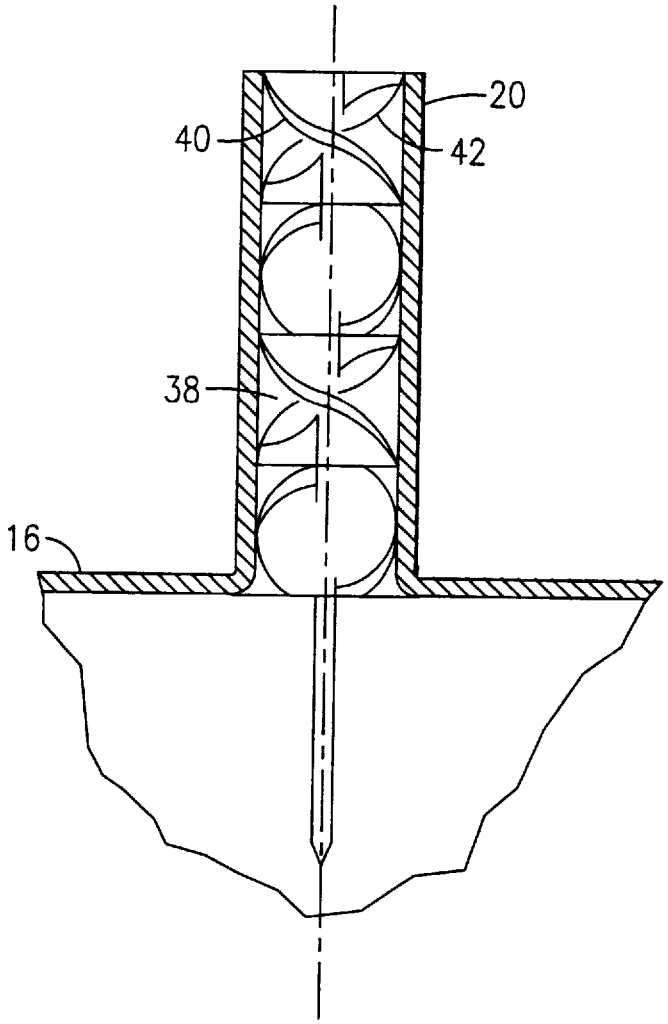
FIG. 9 is a cross-sectional view of a discharge nozzle comprising a static mixer.

Referring to FIG. 9, the discharge nozzle 20 can comprise a static mixer 38 having left hand baffles 40 and right hand baffles 42 used to intermix the ingredients of the chambers 22 and 24 during passage through the discharge nozzle and prior to discharge from the nozzle 20.

The size of the cylinders 22, 24 may, for example, hold approximately 0.6 fluid ounces total of material, making the dispenser ideal for travel kits or promotional use.

The hinges may, in different embodiments, be located in several locations along the outside walls. The preferred embodiment is described above. The hinges could also be located on the adjacent side, which would mean they were parallel to a line passing through axes of the two cylinders. Other combinations and even offset cylinders are also possible.

When the two halves of the dispenser are rotated together, the pistons will tilt or rock as the chemicals are discharged. The pistons must be designed to maintain a seal with the cylinder wall through as much as fifteen degrees of tilt. The design, shown in the drawing, utilizes 9 degrees of tilt at the beginning of dispense stroke and rotates down to zero degrees at the end of the dispense cycle, when the fluid is completely evacuated.

The dispenser of the present invention may be a multi-use dispenser capable of repeated operation or a one-shot disposable dispenser.

What is claimed is:

1. A dispenser for storing and dispensing a plurality of flowable materials comprising:

a) a driving member;

b) a storage member having a discharge nozzle defining a plurality of separate passages and a like plurality of cylinders, for housing the materials, each of the cylinders communicating with a separate one of the passages; and c) hinge means joining the driving member and the storage member, wherein d) the driving member further comprises a piston located and sized to sealingly engage each cylinder when the driving member and the storage member are engaged with one another, whereby the cylinders are isolated from one another and a squeezing pressure is applied so that the driving member and the storage member act against one another to simultaneously expel materials from the cylinders, when therein, through the passage of the discharge nozzle.

2. A dispenser for storing and dispensing two flowable materials comprising:

a single piece container having (a) a driving member, (b) a storage member having a discharge nozzle defining two separate passages and two cylinders, for housing the materials, each of the cylinders communicating with a separate one of the passages and (c) a hinged member joining the driving member and the storage member by way of living hinges, the driving member defines two pistons located and sized to sealingly engage the cylinders when the driving member and the storage member are folded about the living hinges into engagement with one another;

whereby the cylinders are isolated from one another and a squeezing pressure is applied so that the driving member and the storage member act against one another to expel the materials through the passages of the discharge nozzle to be blended at the exit thereof.

3. The dispenser according to claim 2, wherein the living hinges of the hinged member comprise a driving member living hinge and a storage member living hinge, wherein the driving member living hinge interconnects the driving member and the hinged member, and the storage member living hinge interconnects the storage member and the hinged member.

4. The dispenser according to claim 2, wherein the cylinders and pistons are circular in cross-section.

5. The dispenser according to claim 4, wherein the sealing engagement is provided by resilient annular seals defined by the piston and integrally formed therewith to sealingly engage the cylinders.

6. The dispenser according to claim 2, wherein the storage member further comprises a cap, integral with the storage member, which securely seals the passages of the discharge nozzle when desired.

7. The dispenser according to claim 2, wherein a latch means latches the driving member and storage member together when folded into engagement with one another.

8. The dispenser according to claim 2, wherein the discharge nozzle further comprises a static mixer to intermix the ingredients in the cylinders during passage through the discharge nozzle.

9. The dispenser according to claim 2, wherein the hinged member acts to balance movement between the storage member and the driving member during operation so that the pistons maintain a seal with the cylinder wall resulting in maintained dispensing ratios.

* * * * *